US011833557B1

(12) United States Patent
Hoover et al.

(10) Patent No.: US 11,833,557 B1
(45) Date of Patent: Dec. 5, 2023

(54) DEVICE CLEANING SYSTEM AND METHOD OF USE

(71) Applicants: Derrick James Hoover, Lipan, TX (US); Jay Riley, Lipan, TX (US)

(72) Inventors: Derrick James Hoover, Lipan, TX (US); Jay Riley, Lipan, TX (US)

( * ) Notice: Subject to any disclaimer, the term of this patent is extended or adjusted under 35 U.S.C. 154(b) by 0 days.

(21) Appl. No.: 16/354,568

(22) Filed: Mar. 15, 2019

Related U.S. Application Data

(60) Provisional application No. 62/643,872, filed on Mar. 16, 2018.

(51) Int. Cl.
*B08B 9/032* (2006.01)
*B08B 3/10* (2006.01)

(52) U.S. Cl.
CPC ..... *B08B 9/032* (2013.01); *B08B 3/10* (2013.01); *B08B 2203/007* (2013.01); *B08B 2209/032* (2013.01)

(58) Field of Classification Search
CPC ..... B08B 9/032; B08B 3/10; B08B 2209/032; B08B 2203/007; G01F 25/0053
USPC ..... 134/10; 73/1.02, 1.06, 1.16, 1.33, 1.34, 73/1.35, 434
See application file for complete search history.

(56) References Cited

U.S. PATENT DOCUMENTS 4,570,476 A * 2/1986 Davis ..... G01N 9/00 73/1.02
5,072,416 A * 12/1991 Francisco, Jr. ..... G01F 25/003 702/100
5,185,263 A * 2/1993 Kroneis ..... G01N 27/4165 436/17
5,189,901 A * 3/1993 Draus ..... G01D 18/00 73/1.02
5,661,225 A * 8/1997 Ridgeway ..... G01M 3/207 73/1.06
6,055,840 A * 5/2000 Warburton ..... G01N 33/0006 73/1.04
7,028,528 B2 * 4/2006 Antonijevic ..... G01F 1/8472 73/1.16
7,269,991 B2 * 9/2007 Hirsch ..... G01N 33/0006 73/1.02
7,820,029 B2 * 10/2010 Chou ..... G01N 27/4165 205/787.5
8,210,022 B2 * 7/2012 Moriya ..... G05D 7/0635 73/1.35
8,251,081 B2 * 8/2012 Hicks ..... G01F 13/006 137/1
8,554,505 B2 * 10/2013 Vayhinger ..... G01N 27/4163 702/104
10,677,636 B2 * 6/2020 Weindl ..... G01F 25/0046
10,682,451 B2 * 6/2020 Masuda ..... A61M 1/3643
2003/0150252 A1 * 8/2003 Wang ..... G01N 21/274 73/1.06

(Continued)

*Primary Examiner* — Duy Vu N Deo
*Assistant Examiner* — Christopher Remavege
(74) *Attorney, Agent, or Firm* — Leavitt Eldredge Law Firm

(57) ABSTRACT

A device cleaning system cycles a fluid by a clogged or non-functioning device to remove the substances that are built-up on it. The fluid could be heated to facilitate removal and it is considered of importance to use a fluid that is safe environmentally. A clean and functioning verification device is run in the system to compare readings from the non-functioning device. The system is intended to run until the provide similar readings.

1 Claim, 3 Drawing Sheets

(56) References Cited

U.S. PATENT DOCUMENTS

| | | | | |
|---|---|---|---|---|
| 2005/0139238 | A1* | 6/2005 | Ferrara | C11D 11/0041 134/10 |
| 2008/0083262 | A1* | 4/2008 | Augenstein | G01F 25/10 73/1.16 |
| 2013/0319464 | A1* | 12/2013 | Barrett | B08B 9/032 210/167.01 |
| 2014/0188421 | A1* | 7/2014 | Fraser | G01F 15/04 702/100 |
| 2014/0309959 | A1* | 10/2014 | Shen | G01N 33/241 702/100 |
| 2015/0297769 | A1* | 10/2015 | Dobbyn | G01R 3/00 134/99.1 |
| 2017/0107773 | A1* | 4/2017 | Shekhar | E21B 21/08 |
| 2018/0188101 | A1* | 7/2018 | Weindl | G01F 25/0046 |

* cited by examiner

DEVICE CLEANING SYSTEM AND METHOD OF USE

BACKGROUND

1. Field of the Invention

The present invention relates generally to petroleum production systems, and more specifically, to systems for monitoring the content of what is being extracted from a well.

2. Description of Related Art

Petroleum production systems are well known in the art and are effective means to extra hydrocarbons from the earth. For example, FIG. 1 depicts a conventional hydrocarbon production location 101 having a tube 103 through which oil or some type of petroleum product is extracted. Within the tube 103 a measurement device 105 is placed to evaluate the oil passing by. The readings of the measurement device are recorded and used to evaluate the performance of the product.

One of the problems commonly associated with oil well 101 is limited efficiency. For example, the oil being extracted carries impurities or other substances that attach themselves to the measurement device 105. Over time these substances build up on the measurement device 105 and cause distorted readings. The measurement device 105 is discarded and new, clean one is used to replace it.

Accordingly, although great strides have been made in the area of oil production, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
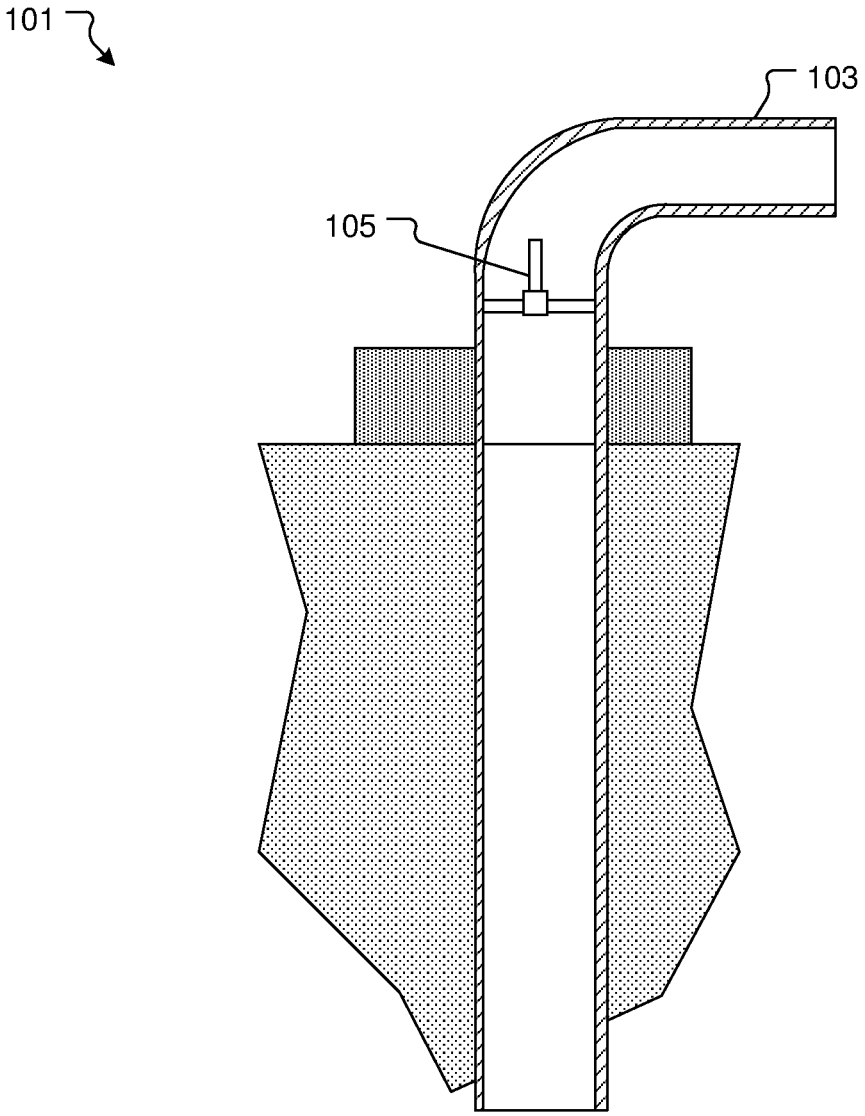
FIG. 1 Prior Art
FIG. 1 is a cross-sectional front view of a common hydrocarbon production location.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional hydrocarbon production. Specifically, the invention of the present application enables the reuse of measurement or other devices by removing the buildup of substances accumulated during use. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
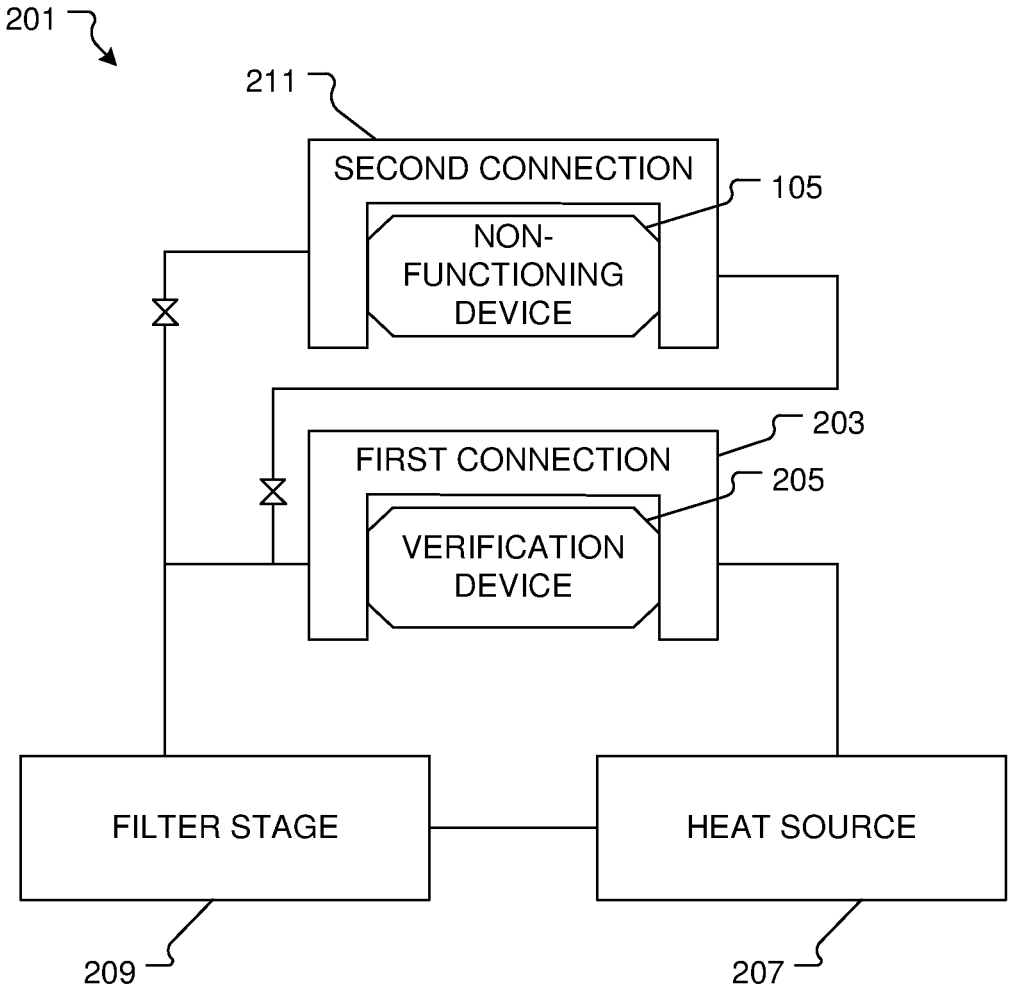
FIG. 2 is a diagram of a device cleaning system in accordance with a preferred embodiment of the present application.

Referring now to the drawings wherein like reference characters identify corresponding or similar elements throughout the several views, FIG. 2 depicts a diagram of a device cleaning system in accordance with a preferred embodiment of the present application. It will be appreciated that system 201 overcomes one or more of the above-listed problems commonly associated with conventional hydrocarbon production locations.

In the contemplated embodiment, system 201 includes a first connection 203 for holding a functioning verification device 205 in fluid communication with a heat source 207 and a filter stage 209. The system 201 having a second connection 211 for holding a non-functioning device 105 also in fluid communication therewith. It is contemplated that measurement devices such as densitometers or the like could be clean with the system but that any device or part with buildup on it could also be cleaned without deviated from the intent of the application.

In use, a device 105 such as a measurement device with attached substances that is not functioning properly is placed in the second connection 211. The second connection 211 and the non-functioning device 105 are isolated from the system. The first connection 203 with its functioning verification device 205 are brought up to a set temperature by cycling fluid therethrough from the heat source 207. The heated fluid is passed through the filter stage 209 to remove any impurities from the fluid. When the system is at the set temperature the non-functioning device 105 is then reconnected with the remainder of the system 101 so that fluid flows simultaneously through the verification device 205 and the non-functioning device 105. The fluid passing through the non-functioning device 105 removes the built-up substances therefrom. The readings from the verification device 205 are compared to those from the non-functioning device 105. The system 201 moves the fluid therethrough until the readings from the verification device 205 and the non-functioning device 105 are generally equal.

It should be appreciated that one of the unique features believed characteristic of the present application is that the second connection 211 enables the removal of the built-up substances on the non-functioning device 105. It will also be appreciated that in this manner the substances and the fluid used to remove the buildup are controlled and are reusable.

Figure 3:
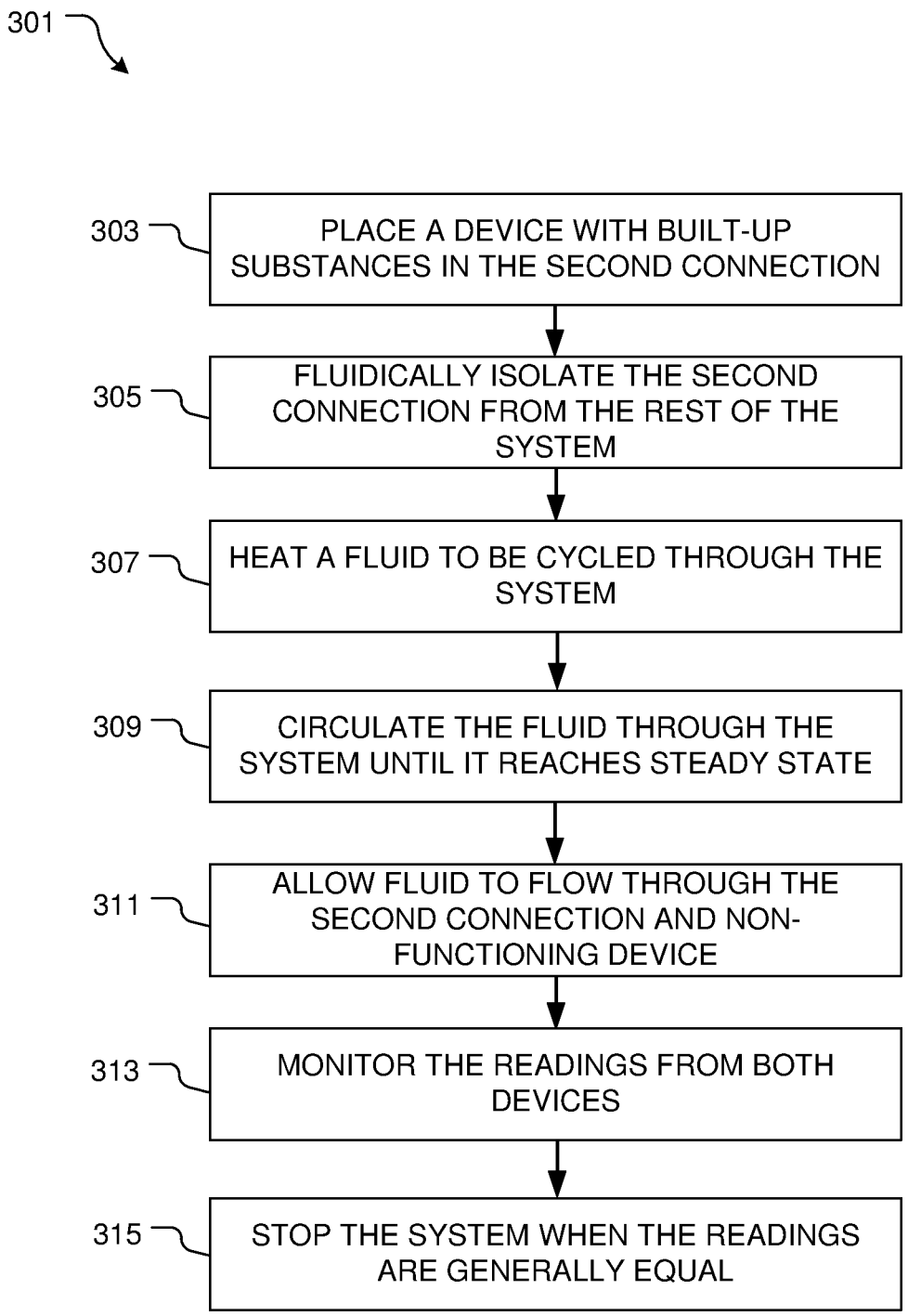
FIG. 3 is a flowchart of the preferred method of use of the system of FIG. 2.

Referring now to FIG. 3 the preferred method of use of the system 201 is depicted. Method 301 including placing a device with built-up substances in the second connection 303, fluidically isolating the second connection from the rest of the system 305, heating a fluid to be cycled through the system 307, circulating the fluid through the system until it reaches a steady state 309, allowing the fluid to flow through the second connection 311 monitoring the readings from both the verification device and non-functioning device 313 and stopping the system when the readings from both devices are generally equal 315.

It will also be appreciated that the temperature of the fluid be circulated in the system will change depending on what fluid is used. It is further contemplated that the fluid might not be heated.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A device cleaning system comprising:

a first connection configured to releasably hold a functioning verification device, the first connection is configured to enable fluid to pass through the functioning verification device;

a second connection configured to hold a non-functioning device, the second connection is configured to enable fluid to pass through the non-functioning device;

wherein the first connection is in fluid communication with the second connection;

a filter stage positioned downstream of the first connection and the second connection;

a heat source positioned upstream of the first connection and the second connection; and a valve positioned downstream of the first connection and upstream of the second connection;

wherein the heat source is in fluid communication with the filter stage, and the filter stage is in fluid communication with both the first connection and the second connection.

* * * * *